US007472964B2

(12) United States Patent
King

(10) Patent No.: US 7,472,964 B2
(45) Date of Patent: Jan. 6, 2009

(54) BABY CARRIER ASSEMBLY WITH EXTENDING STRAPS

(76) Inventor: Tonja L. King, 13819 128th Ave. NE., Kirkland, WA (US) 98034

( * ) Notice: Subject to any disclaimer, the term of this patent is extended or adjusted under 35 U.S.C. 154(b) by 273 days.

(21) Appl. No.: 11/157,329

(22) Filed: Jun. 20, 2005

(65) Prior Publication Data

US 2006/0282947 A1 Dec. 21, 2006

(51) Int. Cl.
*A47D 15/00* (2006.01)
*A47D 1/10* (2006.01)
*A63G 9/00* (2006.01)

(52) U.S. Cl. ..... 297/465; 297/275; 297/274; 297/255

(58) Field of Classification Search ..... 297/274, 297/275, 465, 254, 255, 485
See application file for complete search history.

(56) References Cited

U.S. PATENT DOCUMENTS

| | | | | | |
|---|---|---|---|---|---|
| 1,629,676 | A * | 5/1927 | Buckminster | 482/24 |
| 2,852,066 | A * | 9/1958 | Hawkins | 297/130 |
| 3,992,028 | A * | 11/1976 | Abe et al. | 280/728.1 |
| 4,037,764 | A * | 7/1977 | Almosnino et al. | 224/160 |
| 4,632,425 | A * | 12/1986 | Barratt | 280/801.1 |
| 4,702,523 | A * | 10/1987 | Schrader et al. | 297/485 |
| 5,733,014 | A * | 3/1998 | Murray | 297/485 |
| 5,766,118 | A * | 6/1998 | Conner | 482/129 |
| 6,637,938 | B2 * | 10/2003 | Watkins | 383/23 |

* cited by examiner

*Primary Examiner*—Sarah B McPartlin
(74) *Attorney, Agent, or Firm*—Jensen & Puntigam, P.S.

(57) ABSTRACT

A baby carrier assembly which includes a baby support portion arranged to fit the lower torso of a baby, the support portion including openings through which the legs of the baby extend when the baby is supported upright in the support portion. Two spaced elongated web straps extend upwardly from the rear edge of the support portion. Each web strap includes a rigid hook on the end thereof, configured and arranged to fit over a panel member, such as a bathroom stall door, resulting in the baby being suspended within the support portion from the top edge of the door.

10 Claims, 4 Drawing Sheets

FIG. 4
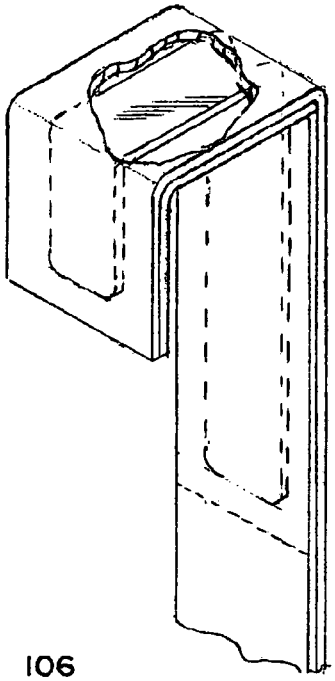
FIG. 6
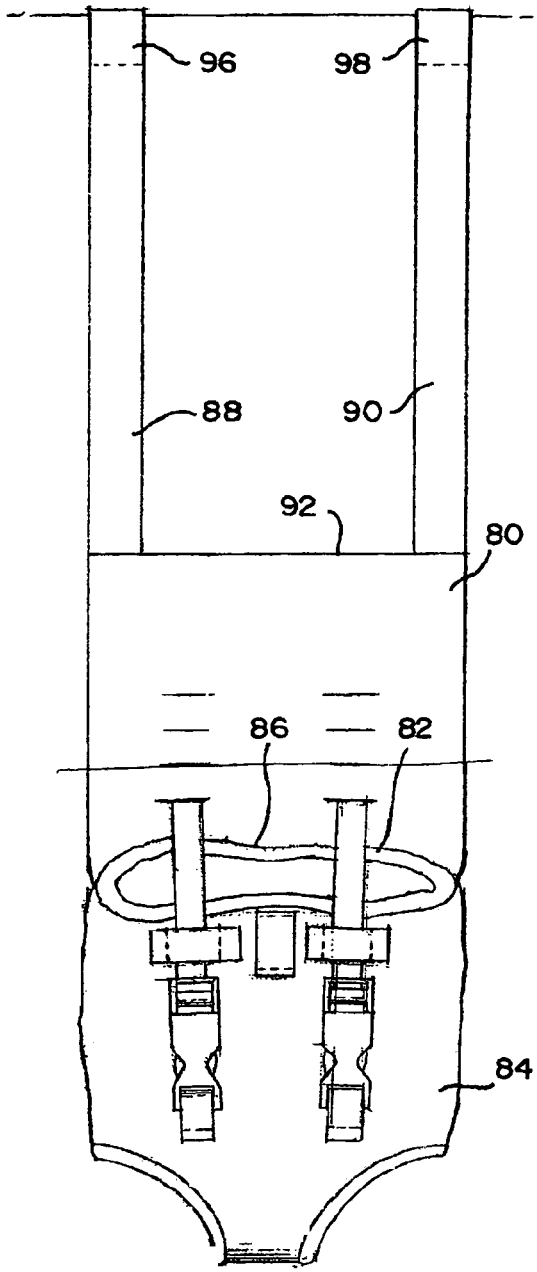
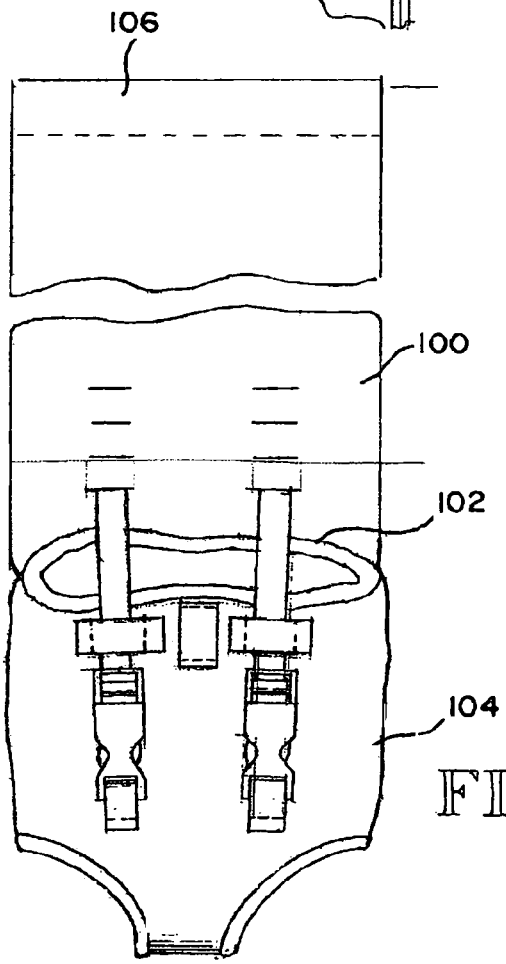
FIG. 7

BABY CARRIER ASSEMBLY WITH EXTENDING STRAPS

TECHNICAL FIELD

This invention relates generally to portable baby carriers, and more specifically concerns a baby carrier in which the baby is supported in an upright position and the carrier is adapted to be supported on a door panel or the like.

BACKGROUND OF THE INVENTION

Baby carriers of various configurations have been known for some time, including fabric-type carriers which extend around the torso of the baby and which are adapted to receive straps on a shopping cart, stroller or the like which are used to secure the baby carrier and the baby in the cart. A disadvantage to such conventional baby carriers, however, becomes apparent when the baby must be moved from the cart for a short period of time while the accompanying adult is engaged in a short-term activity, such as using a public bathroom, trying on clothes in a dressing room or other activity in confined circumstances, where a shopping cart, stroller, etc. may not fit. In such cases, it is problematic as to how to secure the baby properly while still keeping the baby close at hand.

Hence, it would be desirable for a baby carrier to have a capability of providing support for a baby in such physically limited situations.

SUMMARY OF THE INVENTION

Accordingly, the present invention is a baby carrier assembly, comprising: a torso support portion suitable for supporting a baby in an upright position, wherein the torso support portion includes a top edge; and an extending, elongated strap assembly which extends a distance above the baby's head when the baby is positioned upright in the torso support portion, the strap assembly including at least one hook at a free upper end thereof, configured to hook over the top edge of a panel member, supporting the torso support portion with a baby therein.

BRIEF DESCRIPTION OF THE DRAWINGS

FIG. 4 is a perspective, partially cutaway view of the hook/supporting strap portion of the baby carrier.

FIGS. 5-7 are front views of other embodiments of the baby carrier.

BEST MODE FOR CARRYING OUT THE INVENTION

Figure 1:
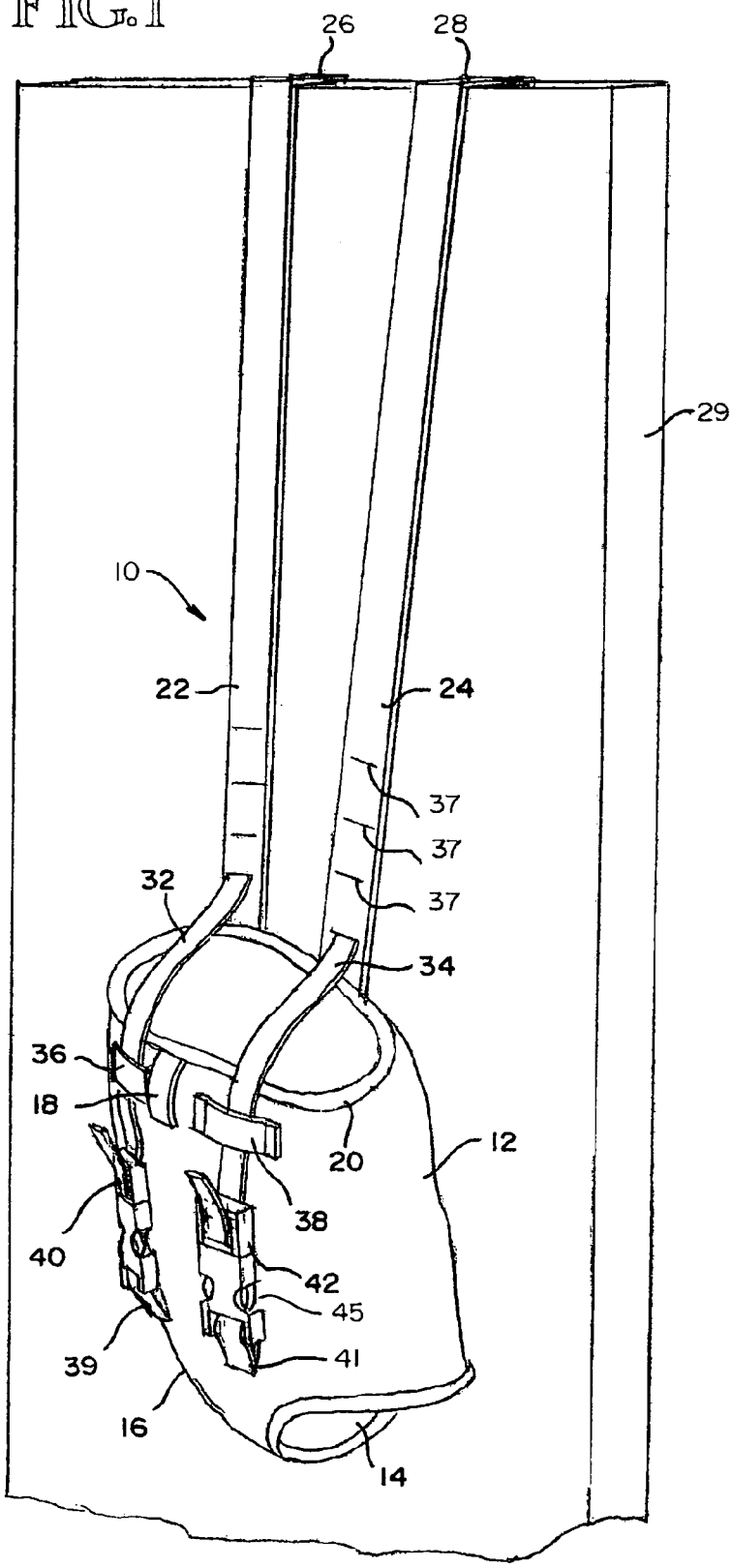
FIG. 1 is a perspective view of one embodiment of the baby carrier.
Figure 3:
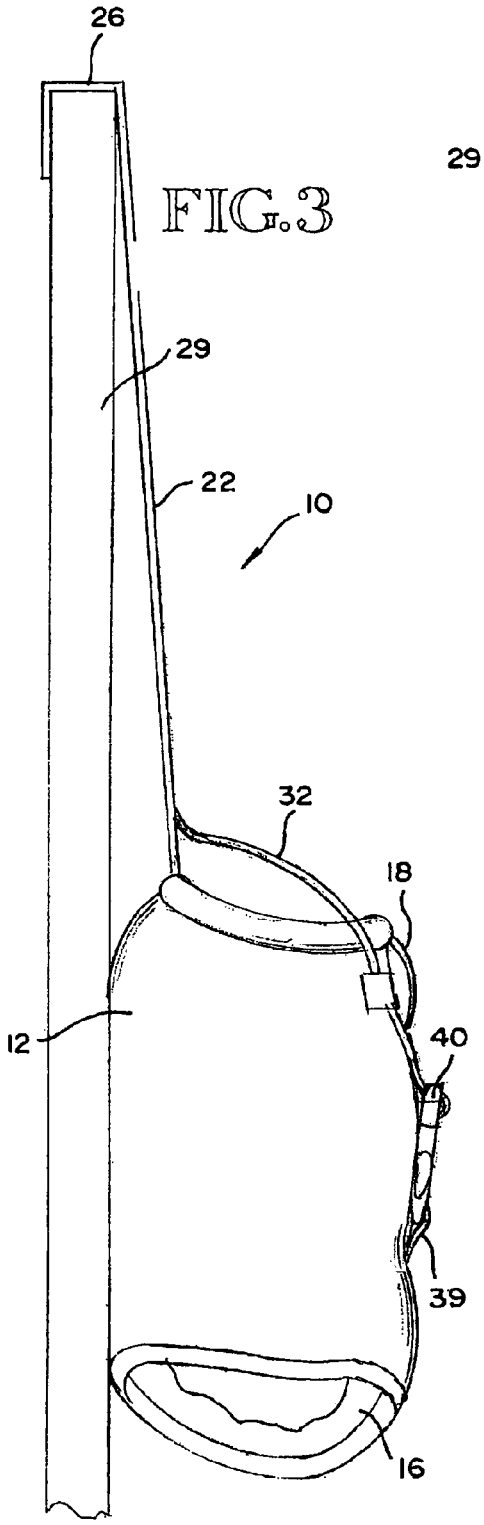
FIGS. 2 and 3 are front and side views of the embodiment of FIG. 1.
Figure 2:
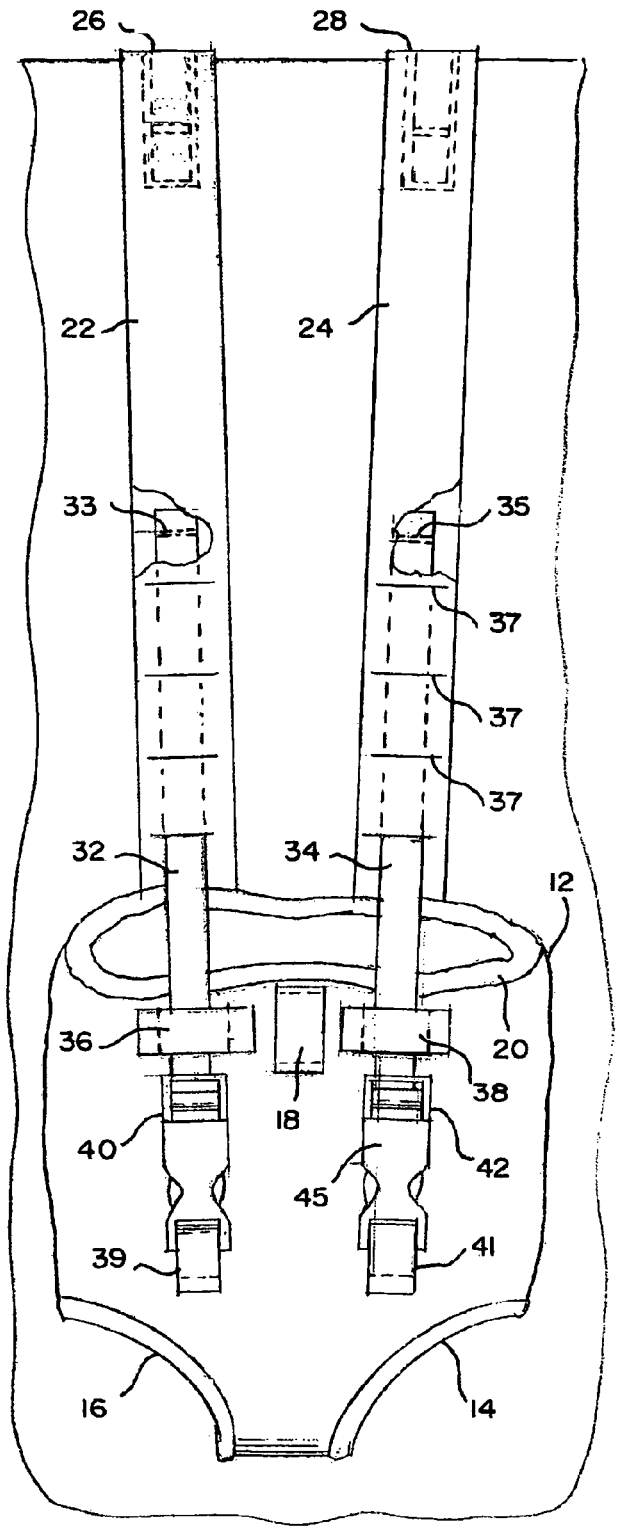

Generally, the various embodiments shown and described herein all include a baby carrier/support portion of generally conventional configuration which is adapted to fit loosely around the lower torso of the baby and a strap assembly which extends upwardly from a rear edge of the baby carrier, and includes extending hooks on the upper end thereof, permitting the baby carrier portion and a baby therein to be suspended from a door or similar member, such as for example a public bathroom stall door or dressing room door.

FIGS. 1-4 show one embodiment of the baby carrier assembly, generally at 10. The baby carrier assembly 10 includes a torso support portion 12, into which a baby can be conveniently placed. The torso support portion 12 in general extends from just below the arms of the baby to slightly below the crotch of the baby, with two openings 14 and 16 through which the baby's legs extend. The torso support portion 12 is generally made of fabric, and in the embodiment shown is padded and strong enough to easily support a baby's weight. This portion of the baby carrier can take various configurations without departing from the spirit of the invention, as long as it adequately holds and supports the baby in an upright position. Generally, a baby in the age range of 6-18 months is appropriate for this arrangement.

The torso support portion 12 can include a central, relatively short, loop 18 which extends vertically and which is sewn to the torso support portion near the top edge thereof. Central loop 18 is arranged to permit a toy or other element, such as a pacifier, to be attached to the torso support portion. Loop 18, however, is not a necessary part of the combination.

The torso support portion 12 has an upper edge 20. Extending from the rear part of upper edge 20 are two elongated straps 22 and 24. In the embodiment shown, the straps are sturdy and non-elastic, made of seatbelt webbing or similar high-strength material. The straps 22 and 24 are two inches wide and spaced three inches apart. In the embodiment shown, the straps are approximately 18 inches long. At the free end of straps 22 and 24 are high-strength rigid metal hooks 26 and 28, which in the embodiment shown are positioned internally of the straps 22 and 24.

Hooks 26 and 28 include a curved section, configured to fit over a door or similar member, in particular, the door of a public bathroom stall, although they could be used with standard doors and panel-like members as well, such as a dressing room stall, for instance. The dimensions and configuration of the individual straps and hooks can vary, as would be clear to one skilled in the art, and as shown below relative to other embodiments.

When the hooks are placed over the upper edge of a bathroom stall door 29, for instance, the remainder of the baby carrier assembly, with the baby being supported by the torso portion, extends downwardly and is safely and conveniently suspended, maintaining the baby in a confined, supported position, while permitting the adult to carry out their business.

The embodiment of FIGS. 1-4 also includes support strap members 32, 34 which are attached at their upper ends 33, 35 to each extending strap 22, 24. Each extending strap includes several horizontal slits 37-37, through which the support strap extends, depending upon the size of the baby.

Strap members 32, 34 extend through horizontal loops 36, 38, respectively, which are located near the upper edge 20 of the torso support portion of the carrier assembly, and are then attached at their lower ends 39, 41 to the torso support portion somewhat above, typically two inches or so, the lower edge thereof, which defines the leg openings 14, 16 of the torso support portion 12.

The support strap members 32, 34 each include a catch 45 which can be engaged and disengaged, resulting in separate strap parts when not engaged, allowing the baby to be conveniently placed in and removed from the baby carrier. Further, each strap member 32, 34 is adjustable, with conventional strap adjustment elements 40 and 42. Straps from a grocery cart or stroller or the like can be extended around the torso support portion and under the catch 45 on each strap member 32, 34 to hold the baby in place in the cart/stroller.

Figure 5:
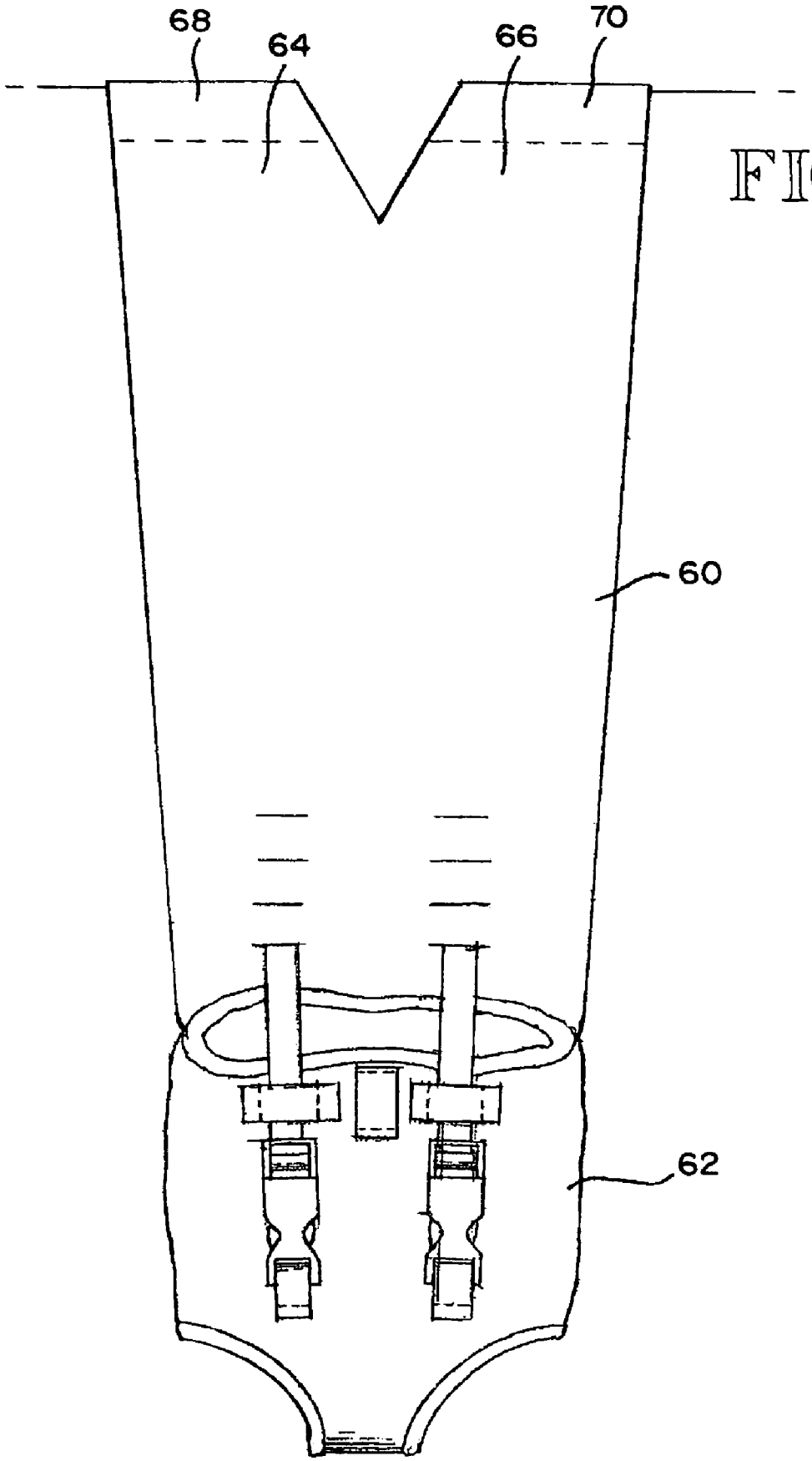

FIG. 5 shows a variation of the embodiment of FIG. 1. In this variation, instead of two separate straps connecting the torso support portion to a door assembly, a single fabric section 60 extends upwardly from a rear edge of the torso support portion 62, which is similar to the torso support portion of FIGS. 1-4. The upper end of fabric section 60 separates into two parts 64, 66, each one of which, at the free ends thereof, includes rigid hook elements 68 and 70, similar to that shown for the embodiment of FIGS. 1-4. These hooks, again, are configured and adapted to hook over the upper edge of a public bathroom or dressing room stall or similar panel member, such as a standard door.

FIG. 6 shows another variation of the baby carrier assembly in which a fabric portion 80 extends upwardly for a selected, typically short distance from back edge 82 of the torso support portion 84 which is similar to the other embodiments. The fabric portion 80 extends for approximately the width of the torso support portion 84, and upwardly from the top edge 86 of the fabric portion 80. Two straps 88 and 90 extend from upper edge 92 of the fabric portion 80, terminating in rigid hook portions 96 and 98 adapted to curve over the top edge of a stall door or similar panel member.

FIG. 7 shows a still further embodiment, in which a fabric portion 100 extends upwardly from a top edge 102 of torso support portion 104, for approximately the width of the torso support portion. In this embodiment, fabric portion 100 extends all the way up to and terminates in one or more hook portions 106, which again hook over the stall door or other door or similar member.

Other variations and configurations of the strap portion(s) of the assembly, which extend from the torso support portion to the rigid hooks and/or include the rigid hooks, are of course possible to one skilled in the art.

All of the above embodiments include a torso support portion for the baby, the torso support portion being arranged so that it, with the baby, can be strapped into a shopping cart, stroller or similar article. Extending from the upper edge of the torso support portion, typically the back or rear portion thereof, is a strap assembly which can have various possible configurations, and has a rigid hook(s) or other connecting element(s) at the upper end thereof. The connecting elements are configured and adapted to extend over the top edge of a bathroom stall door, dressing room door or similar door/panel member. The strap assembly is long enough and strong enough to reliably support the baby in a vertical position, while maintaining the baby at a suitable height. The length of the straps can vary, as long as the baby is reliably and safely suspended. However, the length of the straps may be conveniently chosen so as to place the baby at a mid-level height of the door or other panel, such that the baby can remain conveniently close to the parent or other adult caregiver.

The present article thus solves the desire of a baby's mother, for instance, to safely and conveniently position/support the baby at times when they are using public bathroom facilities, trying on clothes or similar activities.

Although a preferred embodiment of the invention has been disclosed for purposes of illustration, it should be understood that various changes, modifications and substitutions may be incorporated in the embodiment without departing from the spirit of the invention which is defined by the claims which follow.

What is claimed is:

1. A baby carrier assembly, comprising:

a torso support portion suitable for supporting a baby in an upright position, wherein the torso support portion includes a top edge; and an extending, elongated strap assembly, one portion of which extends from a rear section of the top edge of the torso support portion a distance of at least 18 inches, wherein the strap assembly includes another portion comprising two spaced straps which are each attached at one end to a front portion of the torso support portion and which are each attached at an opposing end to the one portion of the strap assembly, the one portion of the strap assembly including at least one hook at a free upper end thereof, configured to hook over a top edge of a panel member, supporting the torso support portion with a baby therein, wherein the one portion of the strap assembly includes therealong a plurality of successively spaced openings, through which the two spaced straps are selectively threaded, to provide a capability of adjusting the position of the two straps relative to the one portion of the strap assembly.

2. The assembly of claim 1, wherein the one portion of the strap assembly includes two separate straps, each one having a hook on the free upper end thereof.

3. The assembly of claim 2, wherein the strap assembly straps are made from a heavy-duty, non-stretchable material.

4. The assembly of claim 3, wherein the material is seat belt webbed material.

5. The assembly of claim 1, wherein the one portion of the strap assembly is a single strap which extends approximately across a part of the rear section of the upper edge of the torso support portion and including at least one hook at a free end thereof.

6. The assembly of claim 5, wherein the one portion of the strap assembly includes a plurality of hooks spaced across the width of the single strap.

7. The assembly of claim 5, wherein the single strap is made from a fabric material.

8. The assembly of claim 1, wherein the one portion of the strap assembly comprises a single strap from a point of attachment to the torso support portion, extending substantially across a rear part of the torso support portion, dividing into two segments at a distance from the torso support portion of greater than one-half of the length of the strap assembly.

9. The assembly of claim 1, wherein the one portion of the strap assembly includes a section of fabric which extends upwardly from the torso support portion and two spaced web strap elements extending upwardly from the fabric section.

10. The assembly of claim 1, including releasable connections at the one end of each of the two straps and on the front portion of the torso support portion, and further including loops attached to the front portion of the torso support portion between the releasable connections on the front of the support portion and the top edge of the torso support portion to maintain alignment of the two straps, respectively, between their attachment to the torso support portion and their attachment to the one portion of the strap assembly.

* * * * *